US005655454A

United States Patent [19]

Rodi

[11] Patent Number: 5,655,454

[45] Date of Patent: Aug. 12, 1997

[54] LAYERED IMPRESSION CYLINDER AND METHOD OF OPERATION

[75] Inventor: Anton Rodi, Leimen, Germany

[73] Assignee: Heidelberger Druckmaschinen AG, Heidelberg, Germany

[21] Appl. No.: 422,453

[22] Filed: Apr. 17, 1995

[30] Foreign Application Priority Data

Apr. 15, 1994 [DE] Germany ..... 44 13 236.0

[51] Int. Cl.[6] ..... B41L 35/14

[52] U.S. Cl. ..... 101/488; 101/170; 101/152; 101/211

[58] Field of Search ..... 101/375, 401.1, 101/211, 152, 487, 488, 170

[56] References Cited

U.S. PATENT DOCUMENTS

| | | | |
|---|---|---|---|
| 4,445,432 | 5/1984 | Ford, Jr. et al. | 101/211 |
| 4,792,860 | 12/1988 | Kuehrle | 358/300 |
| 4,846,065 | 7/1989 | Mayrhofer et al. | 101/467 |

FOREIGN PATENT DOCUMENTS

| | | | |
|---|---|---|---|
| 0 264 604 | 4/1988 | European Pat. Off. . | |
| 487851 | 12/1929 | Germany . | |
| 0578777 | 8/1946 | United Kingdom | 101/375 |

OTHER PUBLICATIONS

Woochenblatt Für Papierfabrikation, 15, 1991, pp. 561–568, (Schuwerk) "Konzeption und Einsatzgrenzen von beheizten Watzen".

*Primary Examiner*—Christopher A. Bennett
*Attorney, Agent, or Firm*—Herbert L. Lerner; Laurence A. Greenberg

[57] ABSTRACT

Reprintable impression cylinder for a printing press, the impression cylinder having an outer cylindrical surface wettable, during printing, with a heated printing ink which is transferrable to printing material or stock, includes two superimposed layers formed on the outer cylindrical surface of the impression cylinder, including an outer layer of relatively lower heat capacity and an inner layer of relatively higher heat capacity.

1 Claim, 1 Drawing Sheet

Fig.1
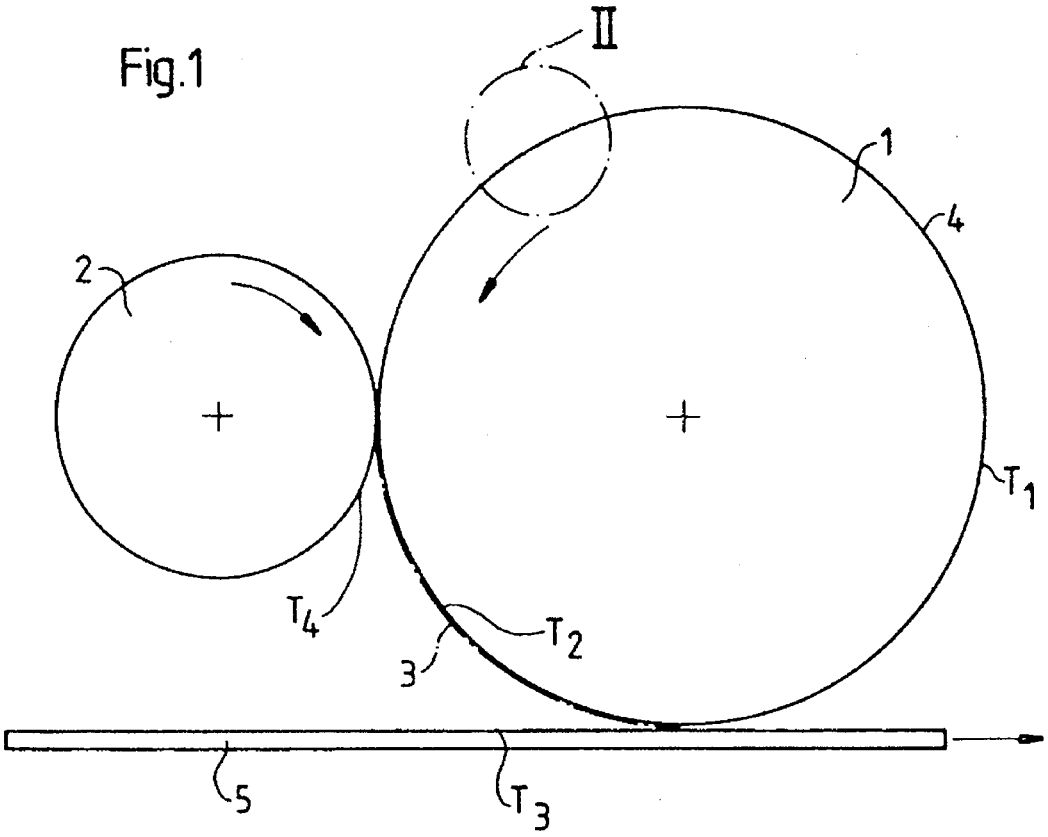
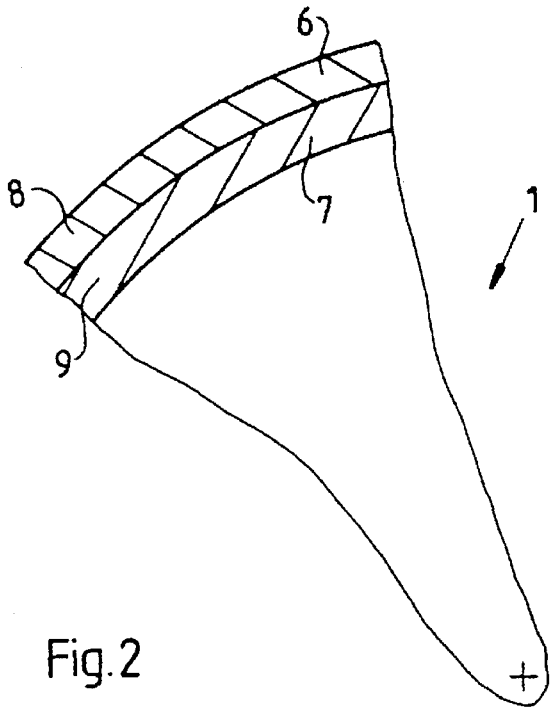
Fig.2

LAYERED IMPRESSION CYLINDER AND METHOD OF OPERATION

BACKGROUND OF THE INVENTION

Field of the Invention

The invention relates to a layered impression cylinder and method of operation thereof and, more particularly, to a so-called reprintable impression cylinder for a printing press, especially an offset printing press, which is wetted with a heated printing ink during printing and transfers the printing ink preferably completely to printing material or stock, and to a method of operating such an impression cylinder.

By a reprintable impression cylinder, there is meant a printing form which can be provided with a respectively desired subject or printing motif by a suitable control or adjustment, during the printing process. In this manner, it is possible that a given subject or motif, which is just then being printed, may be changed during the rotational movement of the impression cylinder so that, with a renewed contact between a given location of the impression cylinder and the printing material or stock, for example, another printed image is produced. It is quite immaterial, with respect to the invention of the instant application, as to how or in what manner the reprinting is to take place, so that further details with respect thereto have been omitted from this specification. What is of particular importance with regards to such a reprintable impression cylinder is that the printing ink is transferred preferably completely to the printing material, such as, paper, for example, during the printing process, so that a clean printed image is formed in subsequent printings, and no losses in quality due to a residue of the previously produced printing occur.

SUMMARY OF THE INVENTION

It is accordingly an object of the invention to provide a layered impression cylinder or reprintable impression cylinder of the foregoing general type which is of simplified construction and affords optimal printing.

With the foregoing and other objects in view, there is provided, in accordance with the invention, a reprintable impression cylinder for a printing press, the impression cylinder having an outer cylindrical surface wettable, during printing, with a heated printing ink which is transferrable to printing material or stock, comprising two superimposed layers formed on the outer cylindrical surface of the impression cylinder, including an outer layer of relatively lower heat capacity and an inner layer of relatively higher heat capacity.

In accordance with another aspect of the invention, there is provided a method of printing with a reprintable impression cylinder of a printing press, wherein the impression cylinder has an outer cylindrical surface wettable, during printing, with a heated printing ink which is applicable to printing material, which comprises transferring the printed ink heated to a temperature $T_4$ to the outer cylindrical surface of the impression cylinder which is unheated, transporting the heated printing ink with the outer cylindrical surface on a path to the printing material and, in the course of which, maintaining the printing ink at a temperature $T_2$ which is higher than a temperature at which the printing ink solidifies, applying the printing ink to the printing material, which is at a lower temperature $T_3$ than the temperature $T_2$, causing the printing ink to solidify, and moving the outer cylindrical surface on a further path thereof between where the outer cylindrical surface had applied the printing ink to the printing material and where the outer cylindrical surface accepts printing ink anew, the outer cylindrical surface on the further path having a temperature $T_1$ which is lower than the temperature $T_2$.

It is further noted that the object of the invention is realized by providing that at least two layers are formed at the outer cylindrical surface of the impression cylinder, namely an outer layer having a relatively low heat capacity and an adjoining inner layer having a relatively high heat capacity. The idea behind these two or more layers is that the printing ink, from the location at which it is transferred to or accepted by the outer cylindrical surface of the impression cylinder until the location at which it is applied to the printing material, such as paper, for example, maintains its printable fluid or liquid state without having to heat the impression cylinder. Due to the relatively low heat capacity of the outer layer, which is preferably a very thin layer, the outer layer accepts the heated printing ink and, due to the relatively low heat capacity thereof, assumes a correspondingly high temperature which is high enough to prevent solidification or hardening of the printing ink on the path thereof to the printing material. The outer layer of relatively low heat capacity is thus formed of a material having relatively good heat conductivity, i.e., is a relatively good heat conductor. The inner layer of relatively high heat capacity adjoining the outer layer represents a thermal insulating layer, and is accordingly a poor heat conductor. A result thereof is that the quantity of heat supplied by means of the heated printing ink remains in the vicinity of the outer layer and does not flow away to other parts of the impression cylinder. Cooling does not take place too rapidly, so that solidification or hardening of the printing ink is prevented. When the printing ink is applied to the printing material or stock, a thermal cooling effect occurs, because the printing material has a lower temperature, such as room temperature, for example, and the ink is applied in solid or hardened form and completely to the printing material or stock. A reliquefying or melting of the ink due to a corresponding high temperature of the outer cylindrical surface of the impression cylinder is prevented in the embodiment according to the invention, so that a very clean print impression can result.

The method of operating the reprintable impression cylinder is as described hereinbefore and hereinafter. The printing ink used therewith may be formed of one or more polymer inks.

Other features which are considered as characteristic for the invention are set forth in the appended claims.

Although the invention is illustrated and described herein as embodied in a layered impression cylinder and method of production, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWING

FIG. 1 is a diagrammatic and schematic view of the layered impression cylinder and the method of its production, in accordance with the invention; and FIG. 2 is an enlarged fragmentary sectional view of FIG. 1 illustrating in greater detail the region thereof defined by the circle II shown in phantom.

DESCRIPTION OF THE PREFERRED EMBODIMENTS

Referring now to the drawing and, first, particularly to FIG. 1 thereof, there is shown therein an impression cylinder 1 to which an ink transfer element 2 is assigned, which applies heated printing ink 3, in accordance with the subject or motif to be printed, to the outer cylindrical surface 4 of the impression cylinder 1. The impression cylinder 1 is a reprintable impression cylinder, as aforedescribed herein, i.e., of the type with which the printed image to be produced is able to be permanently changed during the rotation of the impression cylinder 1. This is effected preferably as a result of conventional electronic control or as a result of an operation based upon any other conventional reprinting principles.

The printing ink 3 in the vicinity of the ink transfer element 2 has a temperature $T_4$. When the printing ink 3 is transferred to the outer cylindrical surface 4 of the impression cylinder 1, the printing ink 3, as well as the outer cylindrical surface 4 therewith, assumes a temperature $T_2$, the temperature $T_4 \geqq T_2$. On its path to printing material or stock 5, such as a paper sheet, for example, the printing ink 3 retains the temperature $T_2$ substantially, the latter temperature remaining so high as to prevent the printing ink 3 from solidifying or hardening. After the printing ink 3 is transferred to the printing material 5, in connection with the printing, the printing ink solidifies or hardens. This occurs because the printing material 5 has a temperature $T_3$ which is lower than the temperature $T_2$. Preferably the temperature $T_3$ is room temperature. When contact takes place between the printing ink 3 having a temperature $T_2$ and the printing material 5 at the lower temperature $T_3$, a chilling effect results.

It is assumed that no printing ink 3 is present any longer on the outer cylindrical surface 4 of the impression cylinder 1 in the course of further rotation of the latter. Deviating therefrom, should slight residues nevertheless remain, they may be removed by means of a suitable non-illustrated cleaning device which, if possible, produces a temperature increase in the outer cylindrical surface 4 within the cleaning region, so as to melt or liquefy the ink residues and remove them. Without a cleaning device, it is assumed that the outer cylindrical surface 4 in the aforementioned region lying between the ink transfer or surrender and a renewed ink acceptance has a temperature $T_1$ which is approximately as high as the temperature $T_3$. Should a cleaning device be provided, the temperature $T_1$ may also be somewhat higher than the temperature $T_3$.

The foregoing method may then be repeated, i.e., the impression cylinder 1 in its imaginatively considered position is wetted anew with printing ink 3 having the temperature $T_4$, and so forth.

FIG. 2 shows that the impression cylinder 1 has two layers 6 and 7 at the outer cylindrical surface 4 thereof, the layer 6 being formed as an outer layer 8 having a relatively lower thermal capacity, and the layer 7 as an inner layer 9 having a relatively higher thermal capacity. By the thermal capacity of the layers 8 and 9, there is meant the ratio of a supplied quantity of heat to the heating or warmth which is attained. Thus, the outer layer 8 is consequently a layer with a high heat conductivity, and the inner layer 9 is a heat insulator. Due to this construction of the impression cylinder 1 in accordance with the invention, assurance is provided that the printing ink 3 remains liquid or fluid during the transport thereof to the printing material or stock 5 and, during printing, is hardened or solidified due to the hereinafore mentioned chilling effect and virtually completely transferred onto the printing material or stock 5. Because no heating device has to be provided at the impression cylinder 1 in the embodiment according to the invention of the instant application, a very simple and economical construction results.

In addition, the heat transfer or acceptance is limited to regions of higher temperatures, and supplemental heating in other zones is prevented.

Based on current theoretical considerations which are by no means mandatory, the temperature $T_1$=70° C., the temperature $T_2$=130° C., the temperature $T_3$=20° C. and the temperature $T_4$=150° C. Other temperatures are, of course, conceivable.

I claim:

1. Method of printing with a reprintable impression cylinder of a printing press, wherein the impression cylinder has an outer cylindrical surface wettable, during printing, with a heated printing ink which is applicable to printing material, which comprises transferring the printed ink heated to a temperature $T_4$ to the outer cylindrical surface of the impression cylinder which is unheated, transporting the heated printing ink with the outer cylindrical surface on a path to the printing material and, in the course of which, maintaining the printing ink at a temperature $T_2$ which is less than or equal to $T_4$ and which is higher than a temperature at which the printing ink solidifies, applying the printing ink to the printing material, which is at a lower temperature $T_3$ than the temperature $T_2$, causing the printing ink to solidify, and moving the outer cylindrical surface on a further path thereof between where the outer cylindrical surface had applied the printing ink to the printing material and where the outer cylindrical surface accepts printing ink anew, the outer cylindrical surface on the further path having a temperature $T_1$ which is lower than the temperature $T_2$.

* * * * *